US006525997B1

(12) United States Patent
Narayanaswami et al.

(10) Patent No.: US 6,525,997 B1
(45) Date of Patent: Feb. 25, 2003

(54) EFFICIENT USE OF DISPLAY REAL ESTATE IN A WRIST WATCH DISPLAY

(75) Inventors: Chanrasekhar Narayanaswami, Wilton, CT (US); Mandayam T. Raghunath, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/607,595

(22) Filed: Jun. 30, 2000

(51) Int. Cl.[7] ..... G04B 19/00; G04B 25/00

(52) U.S. Cl. ..... 368/223; 368/228; 368/231; 368/238; 368/80; 368/82

(58) Field of Search ..... 368/220, 223, 368/228, 238, 231, 240, 80, 82, 239

(56) References Cited

U.S. PATENT DOCUMENTS 4,254,488 A * 3/1981 Ojima et al. ..... 368/82
5,471,438 A * 11/1995 Kobayashi et al. ..... 368/223
5,825,353 A * 10/1998 Will ..... 345/184
5,940,076 A * 8/1999 Sommers et al. ..... 345/339
6,040,837 A * 4/2000 Wong et al. ..... 345/430
6,147,933 A * 11/2000 Bland et al. ..... 368/80
D435,464 S * 12/2000 Bland et al. ..... 368/280
6,271,835 B1 * 8/2001 Hoeksma ..... 345/169
6,278,442 B1 * 8/2001 Griffin et al. ..... 345/169

OTHER PUBLICATIONS

"The World's Smallest PDA Computer Watch", Hammacher Schlemmer Mid Summer 2000 Catalog, p. 3. Mid Summer 2000.

* cited by examiner

*Primary Examiner*—Vit Miska
*Assistant Examiner*—Jeanne-Marguerite Goodwin
(74) *Attorney, Agent, or Firm*—Scully, Scott, Murphy & Presser; Gail H. Zarick, Esq.

(57) ABSTRACT

A wearable mobile computing device/appliance (e.g., a wrist watch) with a high resolution display that is capable of wirelessly accessing information from the network and a variety of other devices. The mobile computing device/appliance includes a user interface that includes software mechanisms for enabling watchface orientation in either of: circular and elliptical modes, and further to enable the further display of textual content in remaining portions of the display when in either circular and elliptical mode.

33 Claims, 5 Drawing Sheets

20
50
75
RF MODEM
76
UART
PCM
78
INTER-FACE
79
PCM
AMP
77
80
BLUETOOTH
81
UART
PCM
89
INTER-FACE
84
PCM
AMP
83
98
OLED/LCD
100
69
INTER-FACE
59
FLASH
58
DRAM
56
57
32 KHz
3.6 MHz
EXP. F x60
OLED/LCD F x50
SPI
68
TPC
X5
X4
JOG ENCODER OR BUTTON
95
TOUCH PANEL
90
CL-XEP 7211
55
POR
BUZ
66
DC/DC
72
TILT
60
Irda
65
MAIN BATTERY
x2
63
BUZZER
x2

EFFICIENT USE OF DISPLAY REAL ESTATE IN A WRIST WATCH DISPLAY

BACKGROUND OF THE INVENTION

1. Field of the Invention

This invention relates generally to mobile computing devices such as personal digital assistants (PDAs), cellular phones, pagers, and the like, and more specifically, to a wearable device/appliance (e.g., a wrist watch) equipped with an interactive user interface that displays a watchface and enables watchface orientation in either of: circular and elliptical modes, in a manner that conserves display real estate for enabling the concurrent display of other textual/graphic content.

2. Discussion of the Prior Art

Computing, mobile and wireless communications technologies have been rapidly advancing-culminating in a variety of powerful user friendly devices such as personal digital assistants (PDAs), cellular phones, pagers, etc. Today, it is possible to purchase handheld PDA's, e.g., palmtops such as the Palm Pilot®, that employ wireless communication devices and that combines computing, telephone/fax, and networking features. A typical PDA may function as a cellular phone, fax sender, and personal organizer and are pen-based, requiring a stylus for text entry. As such, these device incorporate handwriting recognition features and may even employ voice recognition technologies that react to voice input. Small devices such as the RIM 950 and the Motorola PageWriter 2000 pager use a small keyboard for input.

Today, the industry is striving to provide advancements by providing increased PC desktop-like functionality while both decreasing size and power requirements. More recently there have been attempts to incorporate some of the capabilities of the above devices into wrist watches. However, today, only special wearable watch devices are available that, besides time keeping functions, may possess a compass, or a Global Positioning System (GPS), or barometer, heart rate monitor, Personal Handy System (PHS) phone, pager, etc. There are shortcomings in these existing special function watches in that most of them are bulky, are mostly unconnected to the Internet or other PC/network devices, have limited battery life, and, are difficult to use. These currently available special function wrist watches additionally have user interfaces that are quite limited in what they can display. For example, in the context of setting time in digital watches, currently, the user is only enabled to set the hour and minute independently, with time only advancing in one direction. Furthermore, most of them have a 6 to 8 seven segment LED or LCDs which can be used to display 6 or 8 digits/letters, and have a small number of indicators that can display AM/PM, Alarm on/off, etc. only at fixed locations within the display. A few watches are currently appearing on the market that have slightly richer display characteristics. Regardless, these various shortcomings have to be solved, otherwise there is no compelling reason for these watches to become popular. The design of a wrist watch for mobile computing applications offers a significant challenge because the watch is a small device. That is, both fitting components and power supplies such as batteries into such a small volume and given the limited screen size of watches pose limitations that have be overcome. Solving these issues is worthy because the watch is an attractive form as 1) it is one of the few devices that a very large fraction of the population is already accustomed to worldwide, 2) is accessible almost all the time, and, 3) is hard to lose.

It would be highly desirable to provide a wearable device/appliance (a wrist watch) capable of providing time keeping functions equipped with an interactive user interface for displaying a graphic watchface in a manner that conserves display real estate enabling the concurrent display of other textual/graphic content.

SUMMARY OF THE INVENTION

It is an object of the present invention to provide a wearable device/appliance (a wrist watch) capable of wirelessly accessing information and equipped with an interactive user interface and high resolution display for providing a variety of desktop PC-like functions.

It is another object of the present invention to provide a wearable device/appliance (a wrist watch) capable of wirelessly accessing information and equipped with an interactive user interface capable of providing time keeping functions equipped with an interactive user interface for displaying a graphic watchface in a manner that conserves display real estate enabling the concurrent display of other textual content.

According to the invention, there is provided a system and method for efficiently for efficiently utilizing display space provided for a wearable appliance providing time keeping functions, the method comprising steps of providing graphic display of a watch face having minute and hour hand indicators for the time keeping functions, the watchface capable of being displayed in one of circular and elliptical orientations; and, enabling the display of textual content in the display in remaining portions of watchface in both circular and elliptical orientation. Specifically, for the circular watchface orientation, one or more lines of text may be displayed in side portions of said display, with the text rotated clockwise or anti-clockwise depending upon the wearer's viewing preference. Further, for the elliptical watchface orientation, one or more lines of text may be displayed in a normal orientation in top and bottom portions of the display. Preferably, for the elliptical watchface orientation, the length of either or both the minute and hour hands are varied in accordance with the angular position of the hands. For instance, the length of either minute and hour hand or both may be shortened when the minute and hour hand are positioned along a minor axis of the elliptical watch face. Similarly, the length of either minute and hour hand or both may be extended when the minute and hour hand are positioned along a major axis of the elliptical watch face.

BRIEF DESCRIPTION OF THE DRAWINGS

Further features, aspects and advantages of the apparatus and methods of the present invention will become better understood with regard to the following description, appended claims, and accompanying drawings where:

DETAILED DESCRIPTION OF THE PREFERRED EMBODIMENTS

Figure 1:
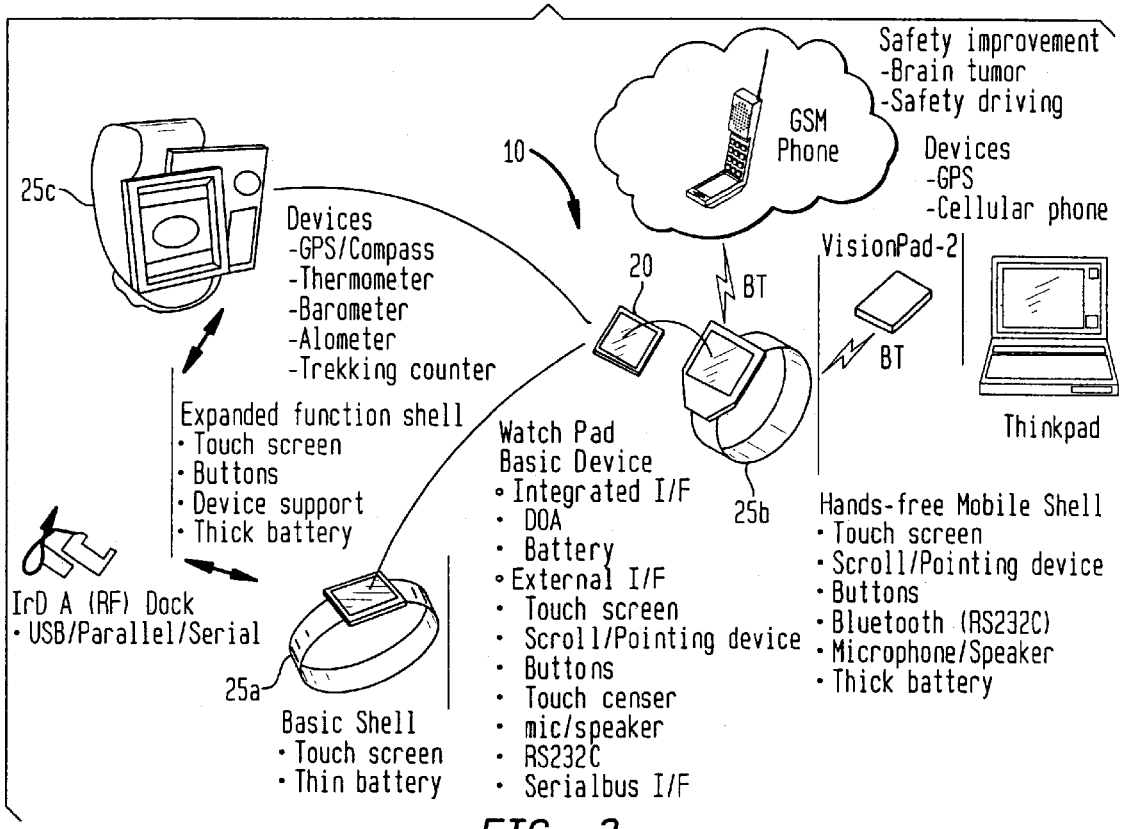
FIG. 1 illustrates conceptually the wearable information access wrist watch device of the invention.

FIG. 1 illustrates conceptually the wearable information access zero wrist watch device of the invention. Referred to herein as the "Wrist Watch" 10, the system looks like a regular watch but is capable of receiving information from adjunct devices such as a PC, a mobile computer, other pervasive devices being carried by the user and directly from a network via a wireless communications mechanism.

As shown in FIG. 1, the Wrist Watch system 10 is based on a modular concept designed to include a motherboard or base card 20 of minimum card size that leverages state-of-the-art technologies as will be described in greater detail herein. Specifically, the base card 20 may be implemented in various types of shells 25*a*, . . . 25*c* for enabling various functions. For example, the base card 20 may be implemented in a basic shell 25*a* providing desk-top like functionality via a touch screen display; a hands-free mobile shell 25*b* providing, in addition to basic desktop functionality, a communications interface with GPS and mobile phone communications capability etc., and including a touch screen display, scroll/pointing devices, and microphone and speaker devices; and an expanded function shell 25*c*, providing touch screen, buttons and support for various devices such as GPS/compass, thermometer, barometer, altimeter, etc.

Figure 2:
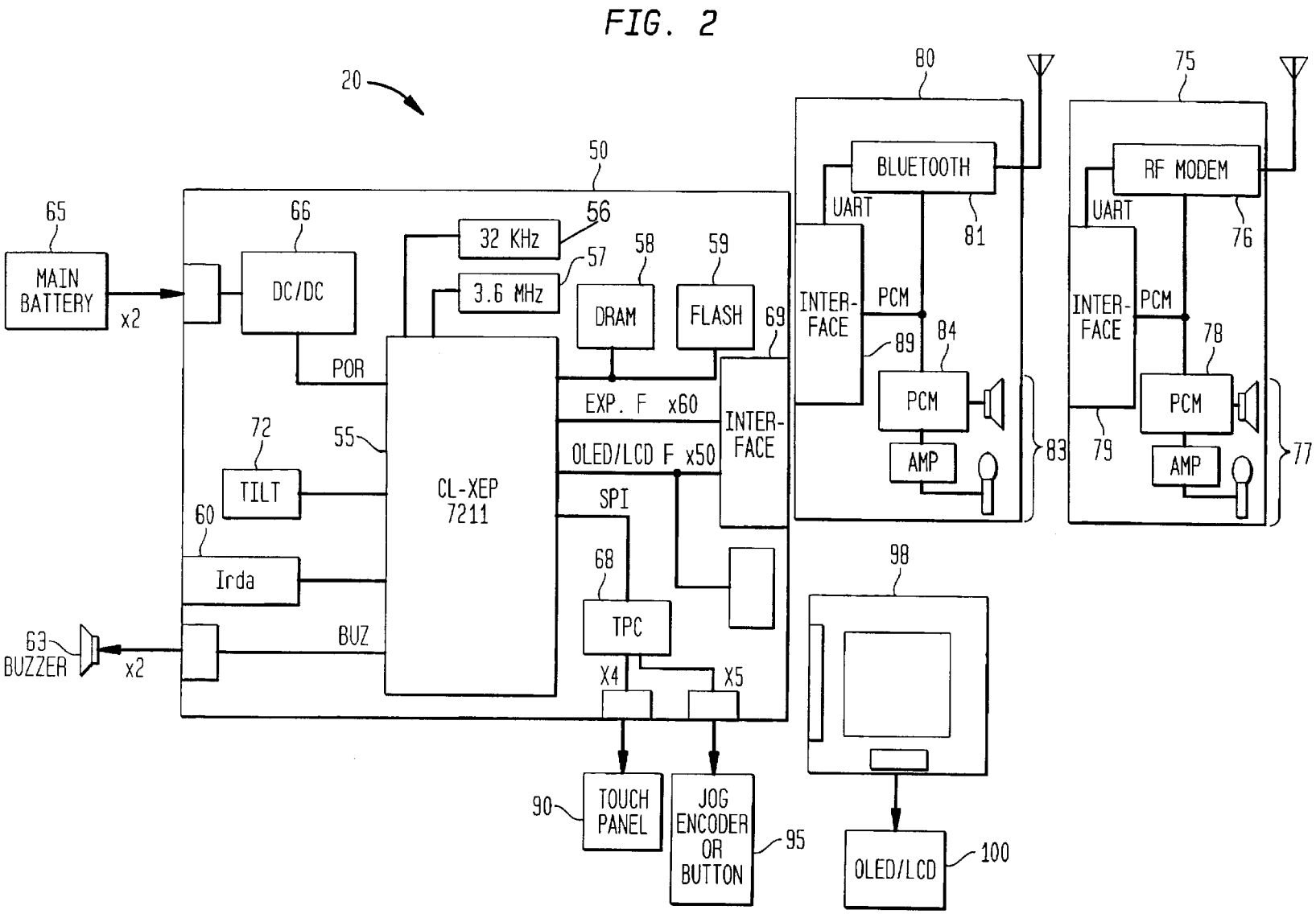
FIG. 2 is a detailed block diagram illustrating the hardware architecture of the Wrist Watch system 10.

FIG. 2 is a detailed block diagram illustrating the hardware architecture of the Wrist Watch system 10. As shown in FIG. 2, the base card 20 includes a first or main card 50 housing the core processing unit, I/O, and memory. For example the main card 50 includes a CPU 55, such as a Cirrus Logic CL-EP7211, which is a single-chip embedded controller functioning as a CPU for ultra-low-power applications, and armed with processing and enhanced memory management features to function equivalently as a 100 MHz Pentium. The core processing unit may operate at 2.5 V, and, to minimize the board size, may be equipped with a 3.68 MHz ceramic resonator 57 for generating the main frequency clock and timing signals, and a crystal-based clock circuit 56 for use in tracking real time. The main card 50 additionally includes sufficient nonvolatile and volatile memory including, for example, 64 Mbit EDO DRAM 58 and SRAM/Flash memory 59 that supports the system code. One communications subsystem of the Wrist Watch 10 includes a line of sight Infrared Data Association (IrDA) communications interface having a low-power IR transceiver module 60 mounted on the card 50 for direct connection with interface decoder pins of the CPU 55 which includes an IrDA SIR protocol encoder. The first card 50 additionally includes various Analog to Digital converters (ADC), memory refresh logic and industry standard interfaces such as a compact flash interface for example, so that other devices could be attached to the Wrist Watch 10. Other interfaces such as Universal Serial Bus (USB), and I2C, etc. may additionally be incorporated. FIG. 2 further illustrates the main card 50 as comprising power supply subsystem including a rechargeable Li-Polymer type battery 65 and a DC to DC converter 66 for supporting a wide dynamic range of Wrist Watch system/sub-system load.

With further reference to FIG. 2, the main card 50 has no audio capability but is equipped with a PCM audio interface in expansion tabs (not shown) for an accessory card, i.e., either card 75 or 80, in the expanded-shell Wrist Watch designs that support PCM audio. Particularly, the accessory card 75, 80 implemented includes a speaker and a microphone combination 77, 83 respectively, with the microphone functioning to record voice input which may be processed by the processor subsystem or stored in a storage subsystem for subsequent playback, and the speaker functioning to provide voice output, produce customized tones, and enable acoustic coupling with other listening devices, etc. As shown in FIG. 2, each speaker/microphone combination 77, 83 is connected to a respective pulse-coded modulation PCM coder/encoder devices (CODECs) 78, 84 which are controlled by a respective PCM interface 79,89 to the CPU 55. The accessory card 75, 80 is additionally equipped with various communications subsystems including low power and intermediary power radio frequency communications devices that support a Wireless Application Protocol ("WAP") used to provide communications links to mobile computers, mobile phones, portable handheld devices and, connectivity to the Internet. In one embodiment, the specific communications subsystems include circuitry for supporting BlueTooth 81 or like small-factor, low-cost radio solution circuitry, e.g., an RF-modem 76, and may include other low power radio and Flex-paging communications circuits (not shown), etc. For instance, as shown in FIG. 2, the auxiliary communication card 80 implements the BlueTooth industry standard for Radio Frequency (RF) communication, however, it is understood that other standards such as IEEE 802.11 or other RF protocols may be implemented as well. Moreover, portions of these communication protocols may be implemented on the processor on the main board 50 so that the total number of the components required is minimized. The CPU system on the main card 50 employs a first Universal Asynchronous Receiver Transmitter (UART1) device (not shown) for supporting either the RF-modem 76 or Bluetooth 81 communications functionality and, may be equipped with a second UART device (UART2) providing support for data download functionality, e.g., from a PC or network server. It is understood that any like data transfer mechanism or data exchange interface device may be implemented to provide data download and RF communications support functionality.

For purposes of interacting with the device, the Wrist Watch system 10 is provided with a touch sensitive screen/panel 90 shaped within a standard watch form factor, and also a roller wheel mechanism, i.e., jog encoder 95. The touch sensitive screen enables the direct launching of applications by physical user entry of a graffiti "squiggle" in the manner such as described in commonly-owned co-pending U.S. patent application Ser. No. 09/607,596 entitled GRAFFITI BASED APPLICATION LAUNCH ON A SMART WATCH, the whole contents and disclosure of which is incorporated by reference as if fully set forth herein, and may initiate other applications/actions/events by physical touching of certain Wrist Watch display areas. In one embodiment, the touch sensitive screen panel is provided with a four (4) position touch screen. For instance, forward and back navigation for Wrist Watch displays is enabled by physically touching certain areas of the touch sensitive panel. The roller wheel mechanism 95 may be rolled up or down (i.e., clockwise or anticlockwise) to simulate a display cursor scrolling function for text and graphics. In the context of the present invention, the roller wheel mechanism 95 generates signals that are A/D converted for receipt by the processor to enable movement of the Wrist Watch display cursor, and more particularly, movement of an arrow cursor or other displayed indicators providing appointment update and browsing functions. Preferably, when the wheel mechanism moves by more than a predetermined amount, e.g., 20 degrees, the wheel generates a signal as a mouse device would when rolled. If a user rolls the wheel continuously, the wheel generates a signal for every 20 degrees of rotation (hereinafter "rotation event(s)"), with the event generated including an indication specifying whether the wheel was turned clockwise or anticlockwise. In this manner, the direction of the roller wheel, and consequently, the direction of cursor movement through a particular display, is tracked by the processor. The roller wheel mechanism additionally may be pushed or depressed to generate a signal (hereinafter "wheel click event(s)"), akin to a keypress or mouse click event, for activating a selected application, hyperlink or a menu item. In one embodiment, the roller wheel device may comprise a bezel which may be rotated and depressed for generating both rotation and wheel click events in the manner such as described in commonly-owned co-pending U.S. patent application Ser. No. 09/607,594 entitled BEZEL BASED INPUT MECHANISM AND USER INTERFACE FOR A SMART WATCH, the whole contents and disclosure of which is incorporated by reference as if fully set forth herein. It is understood that other types of scroll device may be implemented to provide cursor movement, e.g., a slider. Moreover, a standard button may be implemented for providing selection functions. As further shown in FIG. 2, various Analog to Digital converters (ADC) 68 support an interface with the touch screen display panel 90, and an interface with the jog encoder or button for the roller wheel mechanism 95. An interface 69 is provided for a unit 98 housing a high resolution (VGA equivalent) emissive Organic Light Emitting Diode (OLED) high contrast display 100. Further, the main card 50 for the basic shell interfaces to a buzzer 63 controlled directly by the CPU 55 using its buzzer interface and timer counters. To detect the posture of the watch, a mechanical four-way tilt sensor 72 is further provided comprising mechanical switches (for detecting degree of tilt) producing signals which may be detected by the CPU. This sensor may be used for the various purposes such as power management, display control, etc. In a preferred embodiment, additional sensors may be attached to the Wrist Watch device over an interface. Examples may include additional tilt and motion (velocity, direction, speed) sensors, environment sensors such as thermal sensors, pressure sensors, health monitoring sensors such as blood pressure, etc. The Wrist Watch accordingly provides the display for the sensor and may also analyze the data collected from the sensors.

With more particularity, the high contrast display 100 of FIG. 2 does not need a backlight to make the display visible. Thus, the power consumed by the display is proportional to the number of pixels that are turned on in the display. Since the pixels preferably comprise light emitting diodes, the display is automatically visible at-night and a user does not need to press any buttons to see the display. Moreover, the OLED display 100 may be viewed clearly at a wide variety of angles with the brightness of these displays being controlled by limiting the amount of current supplied to the diodes. In one embodiment, the OLED chip 100 is a high-resolution pixel addressable display, e.g., 640×480, for enabling the display of various textual and graphical items on the watch face, similar to what may be displayed on a computer screen or a Palm Pilot®. For example, the time may be represented by drawing the hour and minute hands on a watchface display. Further, the hands of the watchface display may be erased when, at some other time, a display of a photograph is desired to be displayed.

Figure 3:
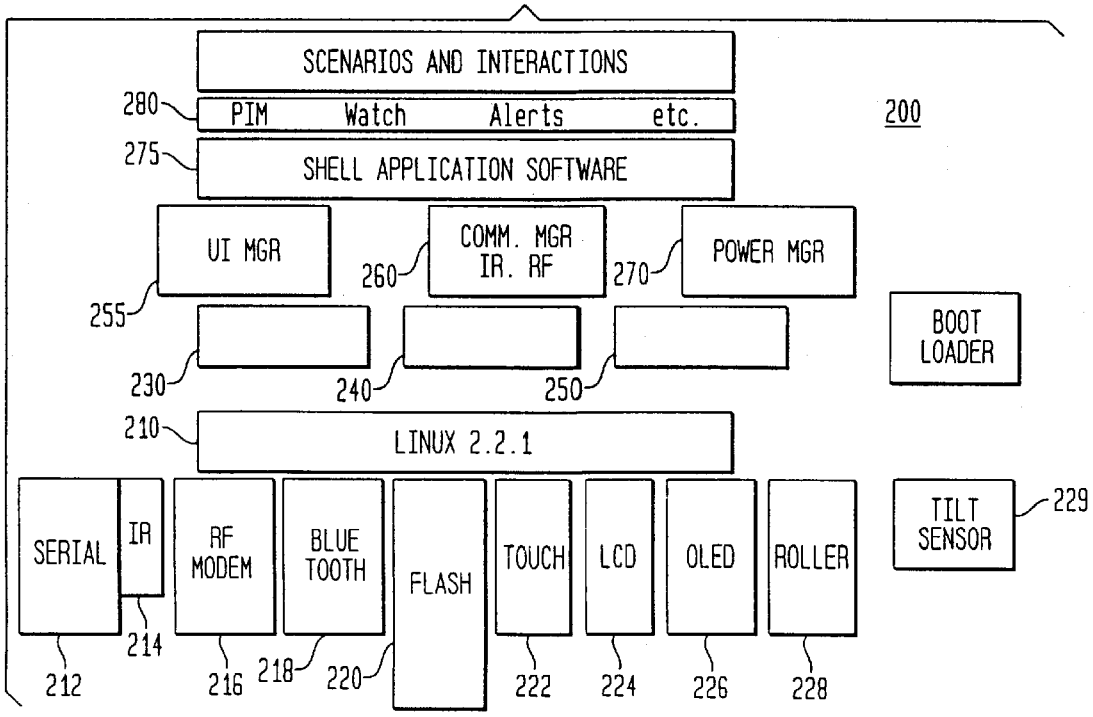
FIG. 3 illustrates the software architecture 200 for the Wrist Watch device 10.

FIG. 3 illustrates the software architecture 200 for the Wrist Watch device 10. At its lowest level, the Wrist Watch system runs an operating system 210, e.g., LINUX 2.2.1, that permits multiple user level and kernel level threads to run and will support multitasking and multi-user support. Device drivers are provided for each input/output subsystem will handle low level device dependent code and interfaces so that higher level Application Programming Interfaces (APIs) can be implemented on top of them. The device drivers provided for each input/output subsystem include a serial I/O system driver 212, IrDA system driver 214, RF-Modem subsystem driver 216, Bluetooth system driver 218, flash memory 220, touch screen subsystem driver 222, LCD subsystem driver 224, OLED subsystem driver 226, roller wheel subsystem driver 228 and tilt sensor device driver 229. A client-server graphics subsystem 230, storage subsystem manager 240 and synchronization sub-system manager 250 is provided on top of the device drivers for receiving and transmitting I/O events between the applications, updating of the screen, etc. A graphics library is available for the application writer so that custom screens may be displayed. A user interface manager 255 is provided to process events received from user input devices such as the roller wheel (jog encoder) and touch panel for the appropriate applications. A communication subsystem manager 260 is provided to handle events from communication channels and pass the events to the right application to set things up for data transfers to proceed. The synchronization manager 250 is provided to synchronize data between the Wrist Watch and the other devices. Particularly, it receives the data from the communication channel and operates in conjunction with the right application to decode the sent data and update the data for the application receiving the data. An example of this would be an update to a calendar event. A system wide power manager 270 is provided to monitor and control power consumption on the device and communicate with other subsystems such as the operating system scheduler to optimize the battery life of the device. The power manager 270, for example, measures the power left in the battery, estimates the power required to run an application, and recommends what subsystems need to be shut down as the battery starts draining out.

Figure 4:
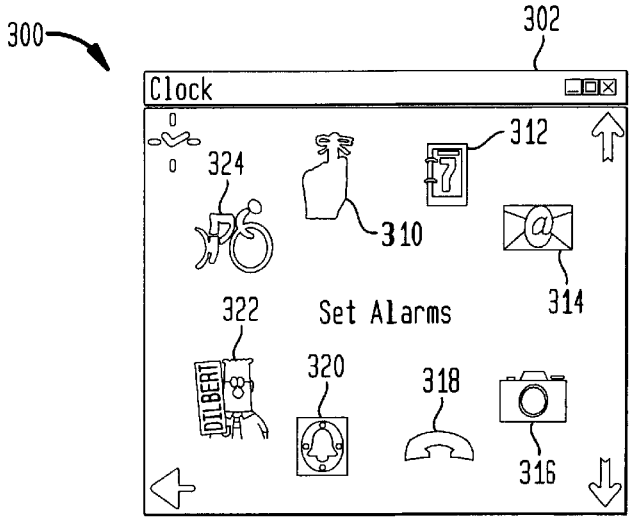
FIG. 4 illustrates an example system display providing respective menu ring of selectable icons for launching Personal Information Management applications provided in the Wrist Watch device.

As further shown in FIG. 3, the Wrist Watch device 10 is equipped with Wrist Watch shell application software 275 provided on top of the basic graphics, communication and synchronization subsystems. One key application supported is the microbrowser which enables access to a WAP-supporting Web site and receives Web-based communications written in, for example, the Wireless Markup Language ("WML") using the XML standard. WML particularly is designed to optimize Internet text data for delivery over limited-bandwidth wireless networks and onto small device screens, and particularly, is devised to support navigation with limited input mechanisms, e.g., buttons. Details regarding the implementation of WML in the Wrist Watch device may be found in commonly-owned, co-pending U.S. patent application Ser. No. 09/608,042 entitled SYSTEM AND METHOD EMPLOYING WML ANNOTATIONS FOR USER INTERFACE CONTROL OF A WEARABLE APPLIANCE the contents and disclosure of which is incorporated by reference as if fully set forth herein. Other supported applications include Personal Information Management (PIM) applications software 280. FIG. 4 illustrates an example system display 300 providing a main menu 302 comprising selectable icons for launching the following PIM applications: an icon 310 for launching an application directed to displaying/maintaining "to do" lists, an icon 312 for launching an application directed to displaying/maintaining calendars and appointments, an icon 314 for launching an application directed to retrieving/storing/displaying e-mail messages, an icon 316 for launching an application directed to retrieving/storing/displaying digital photographs and bit-mapped images, an icon 318 for launching an application directed to retrieving/storing/displaying phone lists, an icon 322 for launching an application directed to retrieving/storing/displaying comic images such as Dilbert© (United Feature Syndicate, Inc.), an icon 324 for launching an application directed to providing stop watch and elapsed time features and, an icon 320 for launching an application directed to setting of time and alarms which is shown highlighted and indicated by the displayed text "SET ALARMS". Other applications may include those enabling the receipt of excerpts of personalized data, such as traffic information, weather reports, school closings, stock reports, sports scores, etc., from the world wide web. These excerpts may be received as notifications or alarms on the Wrist Watch system 10. Inter-device interaction software applications are included to permit the watch display to become the display for another device such as a GPS located in a concealed location, (e.g., a bag), or a thermostat on the wall, etc. Thus, this application software enables communication between the other device and the Wrist Watch by receiving/displaying the data and transmitting back information sent from the Wrist Watch. As a further example, caller Id information may be displayed on the Wrist Watch display when the cell phone that belongs to that person rings. Typically, multiple persons are congregated in a room and carry their cell phones in a hand bag or wear them on their belts, have a hard time determining which cell phone is ringing when a ringing tone is heard in a room. This results in every person in the room pulling out his/her cell phone out of their handbag or belt to check if it is the one that is ringing. The caller Id display feature of the Wrist Watch device is particularly advantageous as each wearer may simply glance at the watch and would immediately know if the ringing phone belonged to him/her, in addition, to determining who the calling party is facilitating the decision of whether or not he/she should answer the phone. In a further example, this application software may allow the data from the Wrist Watch storage subsystem 240 to be viewed on another device such as on a PDA, PC, and other community viewing devices. In the preferred embodiment, middleware such as Tcl/Tk, Javascript, Perl, or the like etc., may run on top of the operating system, graphics and communication manager APIs for facilitating rapid development of these applications on the Wrist Watch device 10.

Figure 5A:
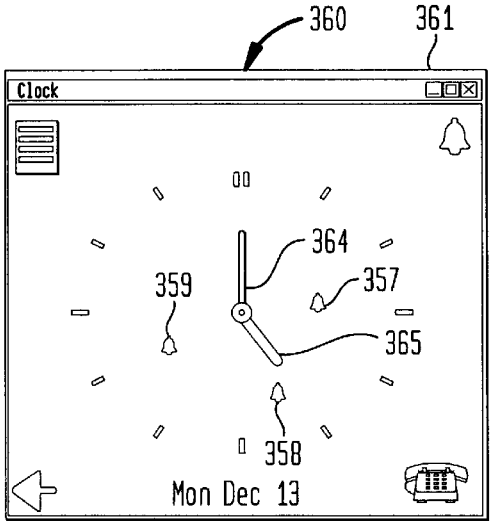
FIGS. 5(*a*) and 5(*b*) illustrate a Wrist Watch display according to a preferred embodiment including an elliptical watch face for permitting text to be displayed in a normal orientation.
Figure 5B:
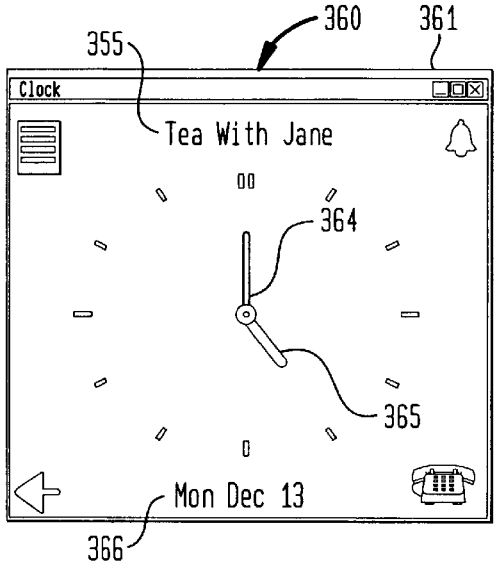

FIG. 5(*a*) is an illustration of an example Wrist Watch display provided via the pixel-addressable display interface 360 according to the preferred embodiment of the invention. As mentioned, the Wrist Watch display is pixel-addressable of a resolution as that of VGA displays, e.g., 640 pixels wide by 480 pixels high. However, as the Wrist Watch is intended to be worn as a wrist watch, the display area is of the order of millimeters and in one embodiment, is approximately 22 mm by 16.5 mm. The present invention is directed to a mechanism for efficiently communicating information via the display. Preferably, the Wrist Watch device display area is of a landscape mode orientation having an aspect ratio of 4:3 for compatibility with most PC displays which have pixel resolutions including 640×480, 800×600, or 1024×768, etc. Additionally, a display having this aspect ratio is advantageous for displaying textual information as a smaller number of wider lines may accommodate more readable text as compared to a larger number of narrower lines.

More particularly, the example Wrist Watch display 360 of FIG. 5(*a*) includes an elliptical watch face 361. As described, the Wrist Watch is provided with basic digital time-keeping function and display for which time is presented as minute and hour hand indicators 364, 365 as shown in the example display of FIG. 5(*a*). It is understood that other features may be provided within the elliptical display such as the display of icons 357, 358 and 359 representing instances of set alarms set in the manner as described in commonly-owned, co-pending U.S. patent application Ser. No. 09/608,043 entitled ALARM INTERFACE FOR SMART WATCH, the whole contents and disclosure of which is incorporated by reference as if fully set forth herein. Furthermore, in accordance with the principles of the invention, as shown in FIG. 5(*b*), text messages may be displayed in a text portion 355 above the elliptical watch face 361 and a text portion 366 below the elliptical watch face. For example, in accordance with the time keeping functionality provided by the device, the current date maybe displayed on the Wrist Watch display portion 366 below the elliptical watch face 361. In accordance with the user-selectable application for downloading, displaying and maintaining calendars and appointments, when a current time coincides with a scheduled appointment time, an associated display message may also be displayed in text field 355. The watch may additionally display for the user the reason for an alarm activation, via the message text provided in the portion 355 above the elliptical watch face 361. This message may comprise a brief title or, optionally, longer more descriptive text associated with the alarm indicated by an icon. If a message is associated with an alarm, the message title will be displayed on the watch display when the alarm is activated so that the user is readily apprised of the message by glancing at the watch. In view of FIGS. 5(*a*) and 5(*b*), the elliptical watch face display 361 increases the amount of space permitting text to be displayed in a normal orientation.

Figure 6:
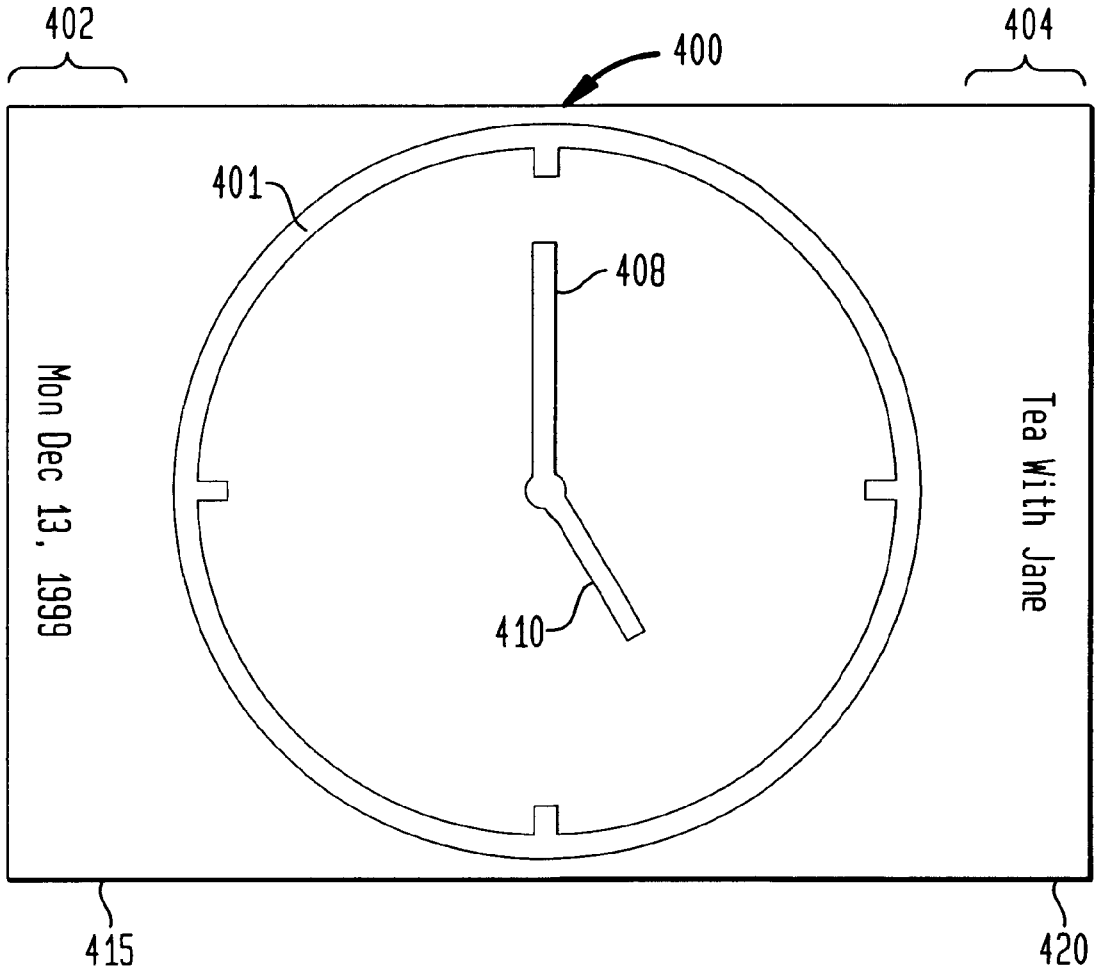
FIG. 6 illustrates a circular watch face display 400 according to one embodiment including lines of text rotated 90 degrees clockwise on opposite sides of the watchface.
Figure 7A:
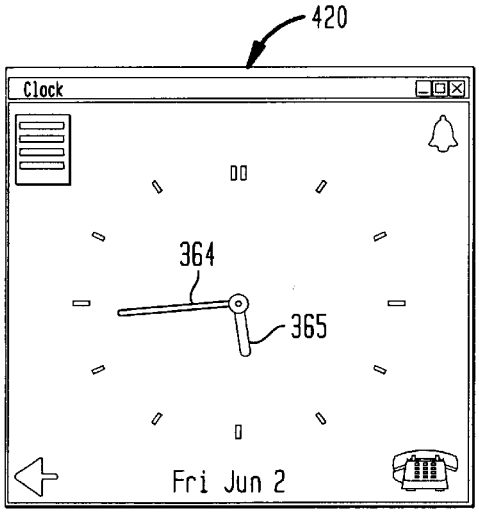
FIGS. 7(*a*) through 7(*d*) illustrate results of the software mechanism implemented for appropriately scaling the watch face minute and hour hands depending upon the angular position of the hands displayed in the elliptical watch face.
Figure 7B:
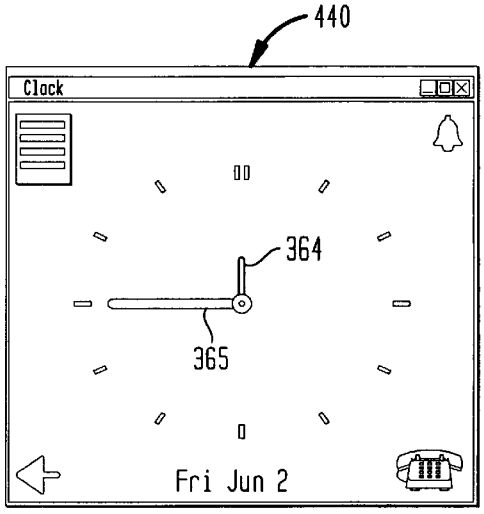
Figure 7C:
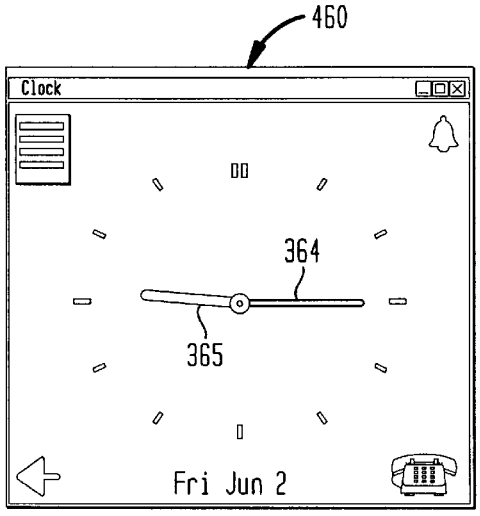
Figure 7D:
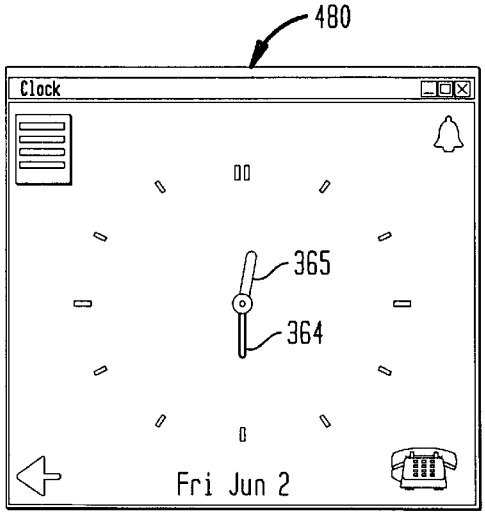

Given that the Wrist Watch display screen dimensions are small to begin with, it is important that information presented on the watch be easily readable. For instance, an important image that is displayed is the watch face including minute and hour hand indicators. As depicted in FIG. 6, in accordance with common watch face designs, a Wrist Watch display 400 may include a watch face 401 of circular orientation which would require approximately up to 480×480 pixels. This design would leave the watch face with only two portions defining strips 402, 404 each of 80 pixels wide by 480 pixels tall on either side of the circular watch face for the display of text information.

Thus, in one embodiment, the portions 402, 404 are narrow and tall strips, and the text may be displayed such that the characters are oriented normally, but are placed one below the other, i.e., the text runs from top to bottom (not shown). However, this embodiment is quite poor from a readability perspective. Preferably, the text is displayed in a manner such as depicted in FIG. 6, with the text characters 415, 420 rotated 90 degrees clockwise. As particularly shown in FIG. 6, the watch face display 400 according to this embodiment includes time keeping watch face minute and hour hands 408, 410 respectively, wherein two lines of text comprising a date 415 and an associated appointment message 420 are rotated 90 degrees clockwise on opposite sides of the watchface. It is the case that more characters may fit in this embodiment, especially if a variable space font is used as most ASCII characters are taller than wider. The embodiment illustrated in FIG. 6 is particularly advantageous when the watch is worn on the user's left wrist, or, when the watch is worn in such a manner that the watch face is on the palm side of the wearer's left hand or, when the user is simply glancing at the watch. It is understood however, that if the watch is worn on the right wrist, or on the palm side of the wearer's right hand, then the text according to the second embodiment may be rotated 90 degrees anti-clockwise. Regardless, in accordance with the second embodiment, the text rotated 90 degrees clockwise or anti-clockwise in the manner shown in FIG. 6, is easier to read than top down text, i.e., with characters oriented the same way as the watch face.

When a user is not simply glancing at the watch, but actually trying to read information on it, e.g., while browsing through ones calendar of appointments, rotated text as shown in FIG. 6 may not be very readable since the wearer is usually holding the watch up to his/her eyes and looking at it straight on. Thus, according to the invention, software is implemented for changing the watch face displayed from that of a circular orientation to an elliptical orientation so as to provide additional watchface display space. In the preferred embodiment of the invention, in accordance with this elliptical watch face presentation, software mechanisms are invoked to proportionally scale the watch face minute and hour hand indicators 364, 365 so that they may be usable in the elliptical display which has a shorter minor axis than the circular watchface orientation such as shown in FIG. 6. Thus, as shown in FIGS. 7(*a*) through 7(*d*), the software mechanism appropriately scales the watch face minute and hour hands 364, 365 depending upon the angular position of the watch face hands (i.e., the time). For instance, in the example elliptical watch face display 420 of FIG. 7(*a*) depicting a 5:45 position the minute hand 364 is in an extended scale while the hour hand 365 is scaled to be shorter as it is along the minor axis of the watch face. It should be understood that either the shortened scale or extended scale may be considered a default or "normal" scale. In the example elliptical watch face display 440 of FIG. 7(*b*) depicting a 9:00 position the minute hand 364 is in the short scale orientation as it is along the minor axis of the watch face while the hour hand 365 is in the normal extended scale. In the example elliptical watch face display 460 of FIG. 7(*c*) depicting a 9:15 position, both the minute hand 364 and hour hand 365 are in the normal extended scale as they are both along the major axis of the elliptical watch face. In the example elliptical watch face display 480 of FIG. 7(*d*) depicting a 12:30 position, both the minute hand 364 and hour hand 365 are scaled shorter as they are both along the minor axis of the elliptical watch face.

While the invention has been particularly shown and described with respect to illustrative and preformed embodiments thereof, it will be understood by those skilled in the art that the foregoing and other changes in form and details may be made therein without departing from the spirit and scope of the invention which should be limited only by the scope of the appended claims.

Having thus described our invention, what we claim as new, and desire to secure by Letters Patent is:

1. A method for efficiently utilizing display space provided for a wearable appliance providing time keeping functions, said method comprising:

a) generating a watch face display having minute and hour indicators for presenting said time keeping functions, said watch face display being pixel addressable for presenting said time keeping functions in one of: a circular orientation or elliptical orientation;

b) enabling display of textual content in remaining portions of said watch face display when said time keeping functions are presented in either of said circular and elliptical orientation; and, c) changing orientation of said watch face display time keeping functions from a circular orientation to an elliptical orientation so as to accommodate placement of additional text content in said remaining portions of said watch face display.

2. The method as claimed in claim 1, wherein for said circular watch face orientation, the step of displaying said text as one or more lines in side portions on either side of said watch face display.

3. The method as claimed in claim 2, wherein said one or more lines are rotated in a clockwise fashion, for facilitating readability of said text for left-hand wearers of said appliance.

4. The method as claimed in claim 3, wherein said readability is improved for user's glancing at said watch face display when in said circular orientation.

5. The method as claimed in claim 2, wherein said one or more lines are rotated in a anti-clockwise fashion, for facilitating readability of said text for right-hand wearers of said appliance.

6. The method as claimed in claim 5, wherein said readability is improved for user's glancing at said watch face display when in said circular orientation.

7. The method as claimed in claim 1, wherein for said circular watch face orientation, the step of displaying said text as one or more lines in top and bottom portions of said display, wherein said lines are oriented normally.

8. The method as claimed in claim 1, wherein for said elliptical watch face orientation, the step of displaying said text as one or more lines in top and bottom portions of said display.

9. The method as claimed in claim 8, wherein said one or more lines are normally oriented for facilitating readability for both right-and left-handed wearers.

10. The method as claimed in claim 1, wherein for said elliptical watch face, varying the length of one or both minute and hour indicators in accordance with the angular position of said minute and hour indicators.

11. The method as claimed in claim 10, wherein said varying includes shortening the length of either said minute and hour indicator when said minute and hour indicator are positioned along a minor axis of said elliptical watch face.

12. The method as claimed in claim 10, wherein said varying includes extending the length of either said minute and hour indicator when said minute and hour indicator are positioned along a major axis of said elliptical watch face.

13. A system for efficiently utilizing display space provided for a wearable appliance having mechanism for providing time keeping functions, said system comprising:

a) mechanism for providing graphic display of a watch face having minute and hour indicators for said time keeping functions, said watch face display being pixel addressable for presenting said time keeping functions in one of: a circular orientation or elliptical orientation;

b) mechanism for displaying textual content in the remaining portions of the watch face display when said time keeping functions are presented in either said circular and elliptical orientation; and, c) mechanism for changing orientation of said watch face display time keeping functions from a circular orientation to an elliptical orientation so as to accommodate placement of additional text content in said remaining portions of said watch face display.

14. The system as claimed in claim 13, wherein said mechanism for displaying textual content enables display of said text as one or more lines in side portions of said display having said circular watch face orientation.

15. The system as claimed in claim 14, wherein said mechanism for displaying textual content display rotates said one or more lines in a clockwise fashion, for facilitating readability of said text for left-hand wearers of said appliance and for user's glancing at said watch face display.

16. The system as claimed in claim 14, wherein said mechanism for displaying textual content display rotates said one or more lines in an anti-clockwise fashion, for facilitating readability of said text for right-hand wearers of said appliance and for user's glancing at said watch face display.

17. The system as claimed in claim 13, wherein said mechanism for displaying textual content enables display of said text as one or more lines in top and bottom portions of said display having said elliptical watch face orientation.

18. The system as claimed in claim 17, wherein said mechanism for displaying textual content display enables display of said one or more lines in a normally oriented fashion for facilitating readability for both right- and left-handed wearers.

19. The system as claimed in claim 13, wherein said mechanism providing display of said elliptical watch face includes mechanism for varying the length of one or both minute and hour indicators in accordance with the angular position of said indicators.

20. The system as claimed in claim 19, wherein said mechanism for varying the length shortens the length of either said minute and hour indicator when said minute and hour indicator are positioned along a minor axis of said watch face.

21. The system as claimed in claim 19, wherein said mechanism for varying the length includes extending the length of either said minute and hour indicator when said minute and hour indicator are positioned along a major axis of said watch face.

22. A program storage device readable by a machine, tangibly embodying a program of instructions executable by the machine to perform method steps for efficiently utilizing display space provided for a wearable appliance providing time keeping functions, said method steps including the steps of:

a) providing graphic display of a watch face having minute and hour indicators for said time keeping functions, said watch face display being pixel addressable for presenting said time keeping functions in one of: a circular orientation or elliptical orientation;

b) enabling display of textual content in remaining portions of watch face display when said time keeping functions are presented in either said circular and elliptical orientation; and, c) changing orientation of said watch face display from a circular orientation to an elliptical orientation so as to accommodate placement of additional text content in said remaining portions of said watch face display.

23. The program storage device readable by a machine as claimed in claim 22, wherein said text is displayed as one or more lines in side portions of said display.

24. The program storage device readable by a machine as claimed in claim 22, wherein said one or more lines are rotated in a clockwise fashion, for facilitating readability of said text for left-hand wearers of said appliance.

25. The program storage device readable by a machine as claimed in claim 24, wherein said readability is improved for user's glancing at said watch face display when in said circular orientation.

26. The program storage device readable by a machine as claimed in claim 22, wherein said one or more lines are rotated in a anti-clockwise fashion, for facilitating readability of said text for right-hand wearers of said appliance.

27. The program storage device readable by a machine as claimed in claim 26, wherein said readability is improved for user's glancing at said watch face display when in said circular orientation.

28. The program storage device readable by a machine as claimed in claim 22, wherein for said circular watch face orientation, the step of displaying said text as one or more lines in top and bottom portions of said display, wherein said lines are oriented normally.

29. The program storage device readable by a machine as claimed in claim 22, wherein for said elliptical watch face orientation, displaying said text as one or more lines in top and bottom portions of said display.

30. The program storage device readable by a machine as claimed in claim 29, wherein said one or more lines are normally oriented for facilitating readability for both right- and left-handed wearers.

31. The program storage device readable by a machine as claimed in claim 22, wherein for said elliptical watch face orientation, varying the length of one or both minute and hour indicators in accordance with the angular position of said hands.

32. The program storage device readable by a machine as claimed in claim 31, wherein said varying includes shortening the length of either said minute and hour indicator when said minute and hour indicator are positioned along a minor axis of said elliptical watch face.

33. The program storage device readable by a machine as claimed in claim 31, wherein said varying includes extending the length of either said minute and hour indicator when said minute and hour indicators are positioned along a major axis of said elliptical watch face.

* * * * *

UNITED STATES PATENT AND TRADEMARK OFFICE

CERTIFICATE OF CORRECTION

PATENT NO. : 6,525,997 B1 
DATED : February 25, 2003
INVENTOR(S) : C. Narayanaswami et al.

It is certified that error appears in the above-identified patent and that said Letters Patent is hereby corrected as shown below:

Title page, Item [54] and Column 1, lines 1-2,
After "DISPLAY" insert -- HAVING CIRCULAR AND ELLIPTICAL ORIENTATION --, and Title page,
Item [75], Inventors, "Chanrasekhar" should read -- Chandrasekhar --

Column 3,
Line 11, delete "zero"

Signed and Sealed this

Thirtieth Day of December, 2003

JAMES E. ROGAN
*Director of the United States Patent and Trademark Office*